US006450080B1

(12) United States Patent
Pochard et al.

(10) Patent No.: US 6,450,080 B1
(45) Date of Patent: Sep. 17, 2002

(54) FIRING MECHANISM FOR ORDNANCE BY STRIKING A DETONATOR

(75) Inventors: Patrick Pochard; Jean-Claude Bourdin, both of Bourges (FR)

(73) Assignee: Giat Industries (FR)

( * ) Notice: Subject to any disclaimer, the term of this patent is extended or adjusted under 35 U.S.C. 154(b) by 1 day.

(21) Appl. No.: 09/613,555

(22) Filed: Jul. 10, 2000

(30) Foreign Application Priority Data

Jul. 9, 1999 (FR) ..... 99 08911

(51) Int. Cl.[7] ..... F41A 19/14
(52) U.S. Cl. ..... 89/27.14
(58) Field of Search ..... 89/27.14; 42/69.01, 42/69.03

(56) References Cited

U.S. PATENT DOCUMENTS

| | | | | |
|---|---|---|---|---|
| 681,109 | A | * | 8/1901 | Dawson et al. |
| 985,171 | A | * | 2/1911 | Hermsdorf |
| 2,245,621 | A | | 6/1941 | Summerbell |
| 4,207,795 | A | * | 6/1980 | Reed et al. |
| 5,229,539 | A | * | 7/1993 | Rommel |
| 5,410,942 | A | * | 5/1995 | Begneu |
| 5,604,326 | A | * | 2/1997 | Lescure |
| 5,610,361 | A | * | 3/1997 | Vernet et al. |
| 6,070,512 | A | * | 6/2000 | Rohrbaugh |
| 6,212,990 | B1 | * | 4/2001 | Elspass |

FOREIGN PATENT DOCUMENTS

| | | | |
|---|---|---|---|
| DE | 147526 | | 1/1904 |
| DE | 0183692 | * | 4/1907 |
| DE | 0195269 | * | 2/1908 |
| DE | 026430 | * | 2/1910 |
| FR | 352492 | | 8/1905 |
| FR | 1264561 | * | 5/1961 |
| GB | 22209 | * | 9/1911 |
| GB | 19934 | | 9/1915 |
| JP | 159992 | * | 6/1994 |

* cited by examiner

*Primary Examiner*—Michael J. Carone
*Assistant Examiner*—Troy Chambers
(74) *Attorney, Agent, or Firm*—Parkhurst & Wendel, L.L.P.

(57) ABSTRACT

An ordnance firing mechanism for striking detonators by a strike pin which is translatable relative to a support, the strike pin being driven in translation by actuation apparatus including a lever connected to the strike pin and pivotable relative to the support, a pivotable pawl able to release the lever 4, a propelling device acting on the lever and affixed to the support 1, a driver acting on the pawl and through it implementing rotation of the lever thereby arming the strike pin and releasing the lever, the driver including a control rod for translation relative to the support and having recesses cooperating with the pawl and with a heel cooperating with the lever.

10 Claims, 4 Drawing Sheets

FIRING MECHANISM FOR ORDNANCE BY STRIKING A DETONATOR

BACKGROUND

The present invention relates to the field of ordnance firing mechanisms for striking detonators.

In known manner, ordnance firing mechanisms comprise a spring-driven strike pin which is compressed, and forces the strike pin into an armed, retracted position during the entire time of weapon use, that is, as long as firing has not been triggered. When the strike pin is released, the spring projects onto the detonator's primer to ensure ignition. It follows that such a firing mechanism will require means for releasing the strike pin and means for restoring it to its initial position and locking it. A strike pin of this kind is described in U.S. Pat. No. 2,245,621, the pin being reset into its armed position as the breech is being closed. Such a system is undesirable because it might lead to premature firing and put weapon operators in great danger.

German Patent 147,526 describes an ordnance firing mechanism or igniter comprising a spring-driven strike pin. A latch stop permits retraction of the strike pin by extending its spring when rotating a weapon lever. This lever in turn rotates a second lever about a shaft comprising a pawl cooperating with the latch. At the end of the rotation of the weapon's lever, the pawl detaches from the latch and thereby releases the strike pin.

This design allows extending the strike-pin spring only at the time of firing, whereby the previously cited drawbacks are avoided. Nevertheless this design entails rotating the weapon lever which in turn provides a substantial clearance volume underneath the firing mechanism.

BRIEF SUMMARY OF THE INVENTION

An objective of the present invention is to provide a novel design for operating a strike pin, whereby a spring attached to said strike pin need not be subjected to constant tension and bulk is substantially reduced.

Accordingly an objective of the invention is an ordnance firing mechanism operating by striking a detonator with a strike pin translationally displaceable relative to a support, said strike pin being translationally driven by actuation systems consecutively assuring that:

- the strike pin will move from a rest position into an armed position wherein a propelling device for the strike pin is armed;
- the strike pin will be moved from the armed position to a firing position wherein it is propelled by the propelling device onto a detonator; and
- the strike pin will be kept in said rest position, the actuation systems ensuring that the strike pin will be kept in said rest position.

The firing mechanism or igniter is characterized in that the actuation systems comprise:

- a lever connected to the strike pin and pivoting relative to the support;
- a pivoting pawl which can release the lever;
- a propelling device driving the lever and firmly joined to the support; and
- drive means acting on the pawl and through it causing the lever to rotate and then arm the strike pin, and then release the strike pin.

The drive means setting the lever in rotation comprises a control rod which is translationally displaceable relative to the support, the rod being fitted with recesses cooperating with the pawl on one hand and on the other with a heel cooperating with the lever.

Advantageously a first recess comprises a cylindrical contour wherein the pawl begins its rotation, followed by a second recess wherein the pawl will be masked to allow the lever to rotate about its shaft.

The depth of the second recess corresponds to the strike path of the strike pin.

Advantageously the heel is situated beyond the second recess to cooperate with a slope on the lever to return this lever to its initial position.

The rod is restored to its initial position by a return spring and it is driven in rotation by a hydraulic piston or jack.

The lever's propelling device is an arm, one end of which rests against the lever and the other end of which is rigidly joined to a torsion bar, the other arm end and the torsion bar being affixed to the support.

One end of the lever is affixed to the strike pin and the other end to a shaft rotating relative to the support, the pawl being mounted in rotatable manner about this lever at a location between its two ends.

The torsion bar is initially prestressed.

The lever may be in the form of a plate comprising clearances to reduce its moment of inertia.

Advantageously the pawl is attached by a spring to the lever.

In a particular embodiment of the invention, the strike pin comprises a first groove perpendicular to the strike-pin's axis and entered by the end of the lever, and a stud projecting from said groove keeps the lever in it.

The strike pin is fitted with means permitting its removal and comprising at lest two recesses on the rear side to permit gripping it, and a second groove parallel to the strike-pin axis and communicating with the first groove, the lever moving through the second groove following retraction of the stud and rotation of the strike pin.

A first feature of the apparatus of the invention is that the strike pin always is in the rest position when the weapon's breech is closed.

Another feature of the invention is that the strike pin is not kept in place by a stop means precluding spring relaxation.

Another advantage of the invention is the ability to adjust the prestressing of the torsion bar.

Another advantage is igniter compactness.

BRIEF DESCRIPTION OF THE DRAWINGS

Other features, details and advantages of the present invention are stated in the following description of illustrative embodiments and in relation to the attached drawings.

DETAILED DESCRIPTION

Figure 1:
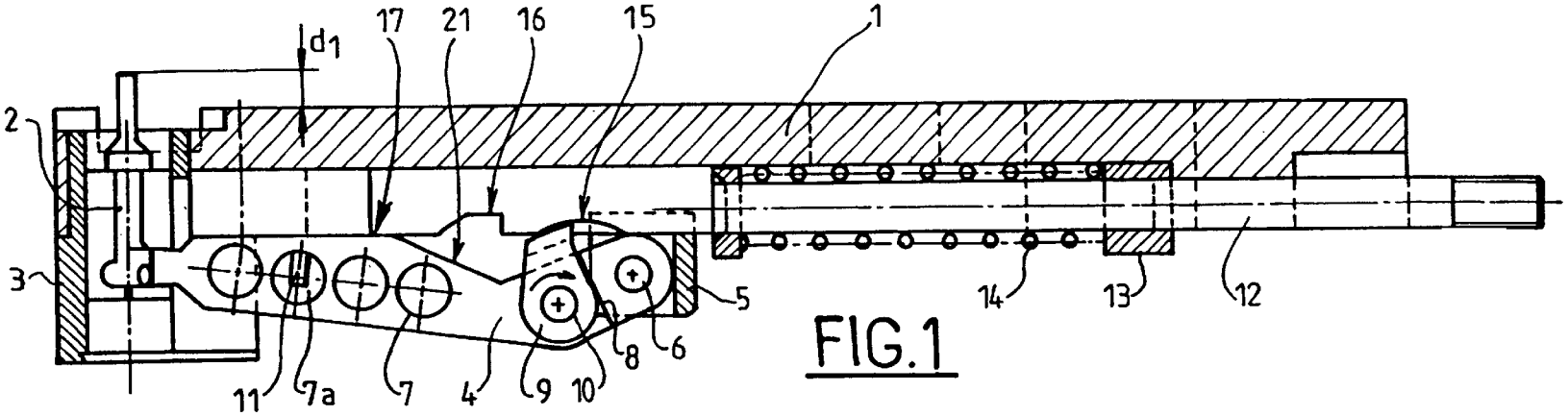
FIG. 1 is a partial longitudinal sectional view of the rear portion of a weapon, the section passing through the strike pin.

FIG. 1 shows a partial section of a weapon in the longitudinal direction at the detonator strike-pin. In this figure, reference numeral 1 denotes the support corresponding to a weapon's rear portion representing various components for understanding the invention. To implement firing, the weapon is fitted with a strike pin 2 sliding in a housing 3 firmly joined to support 1. It is understood that a set of detonators, not shown, is configured opposite this strike pin, and that said detonators are initiated progressively by being struck during translation of the strike pin.

In the invention, the strike pin 2 is attached to actuation means primarily comprising lever 4, pawl 9, a propelling device in the form of an arm 11, torsion bar 18, and drive means in the form of a displaceable rod 12. Lever 4 rotates on a hinge 5 firmly affixed to support 1. FIG. 1 shows the hinge shaft permitting lever 4 to rotate in the plane of the figure. Lever 4 includes a number of apertures 7 to reduce its moment of inertia about its shaft of rotation 6 and thus reduce the strike's response time. Lever 4 comprises a surface 8 and a pawl 9 rotatable on shaft 10 relative to said lever, and is kept at constant pressure (in the direction of the arrow) against surface 8 by a return spring, not shown.

Arm 11 enters one of the apertures, for instance 7*a*, to drive lever 4 in the manner described below.

The rod 12 is located substantially parallel to lever 4 and slides through a cap 13 affixed to support 1, and is attached to spring 14 the purpose of which is to return rod 12 to its initial state as schematically shown in FIG. 1. The rod 12 is fitted with a first cylindrical recess 15, a second recess 16 and a heel 17. The pawl 9 may enter the first and second recesses as discussed below when traction is applied to the rod 12.

FIG. 1 shows that the strike pin 2 projects slightly above the support 1 by a distance d1. However, it is understood that in the rest position this strike pin 2 will be safely away from the detonator primer.

Figure 2:
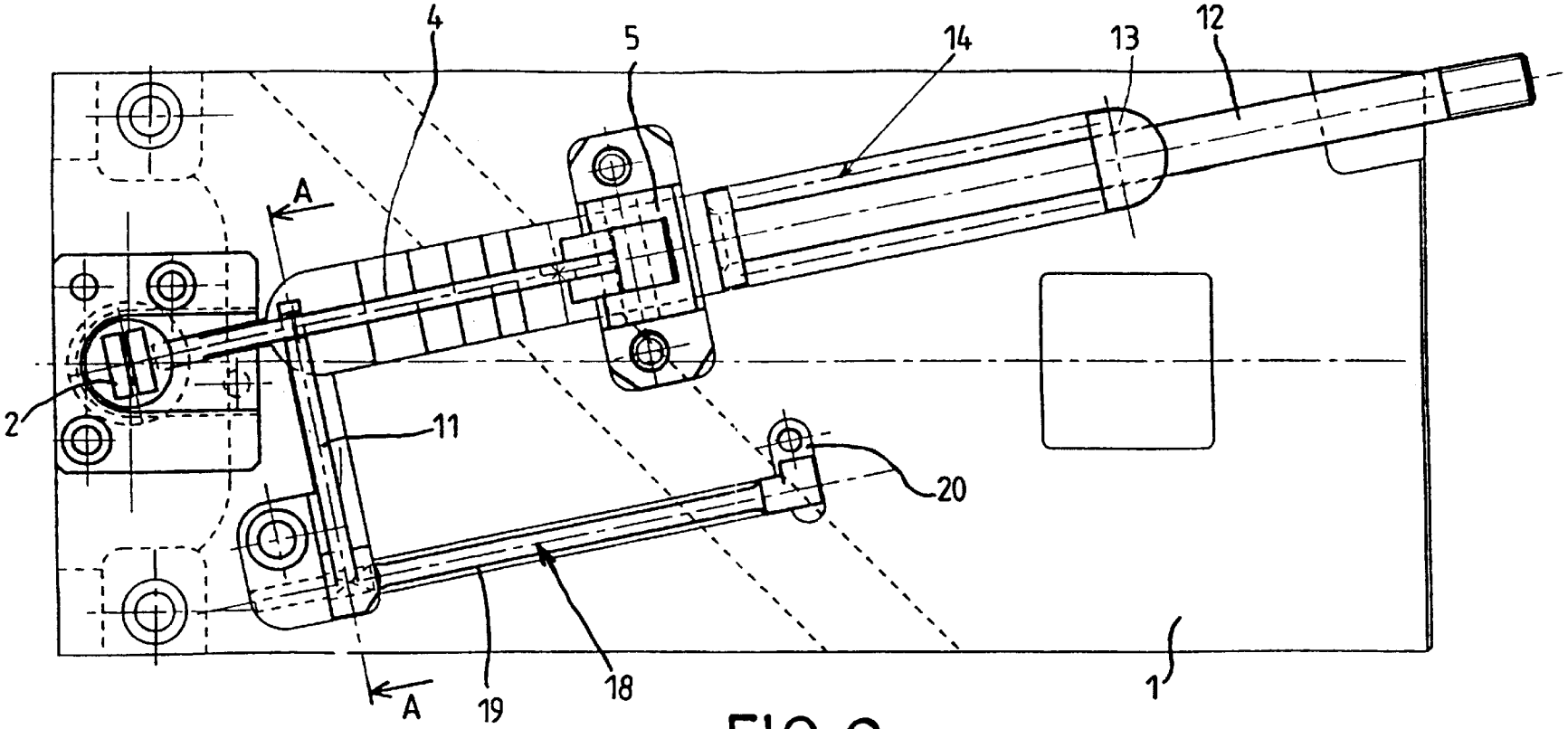
FIG. 2 is a top view corresponding to FIG. 1.

FIG. 2 is a view from below support 1 of the strike pin 2, the lever 4 and rod 12 attached to spring 14. the arm 11 is mechanically connected to one end of a torsion bar 18 configured in a housing 19 in support 1. The other end of torsion bar 18 is rigidly joined to housing 19, illustratively by means of a bracket 20. In the course of assembly, the bar 18 will be prestressed into a slight twist.

Strike-pin percussion is carried out in the following manner.

Figure 3:
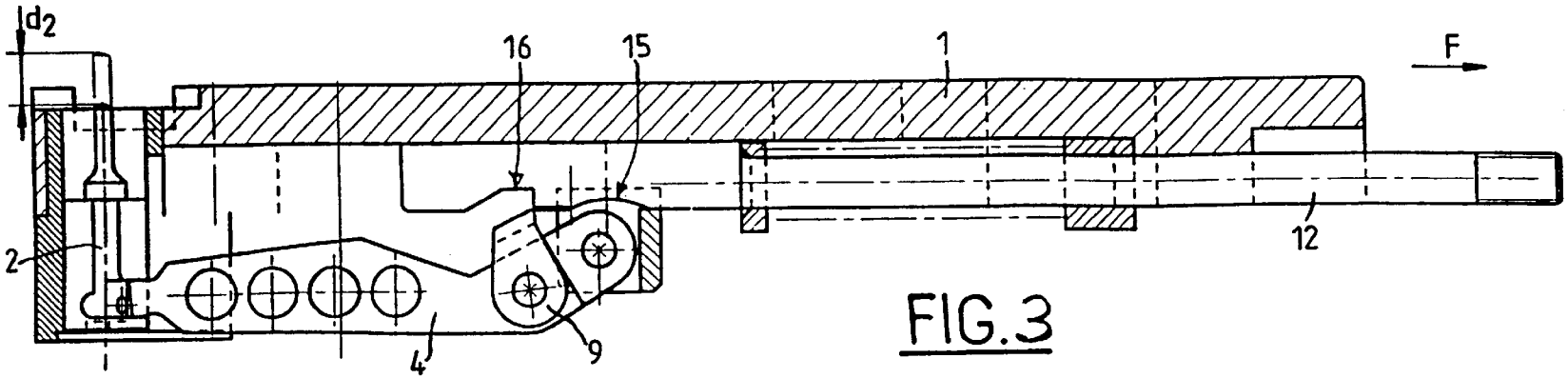
FIG. 3 shows another stage of operation, from the viewpoint of FIG. 1.

Beginning with the initial rest phase shown in FIG. 1, the rod 12 is pulled, for instance using a hydraulic jack (not shown) to start the operational phase shown in FIG. 3. In this intermediate position, pawl 9 already has passed through recess 15 and is near recess 16. The rod 12 propels the pawl and causes lever 4 to rotate and consequently strike pin 2 will be retracted by a distance d2. The torsion in bar 18 is thereby increased during this phase by being displaced by a distance d2 relative to the support 1.

Figure 4:
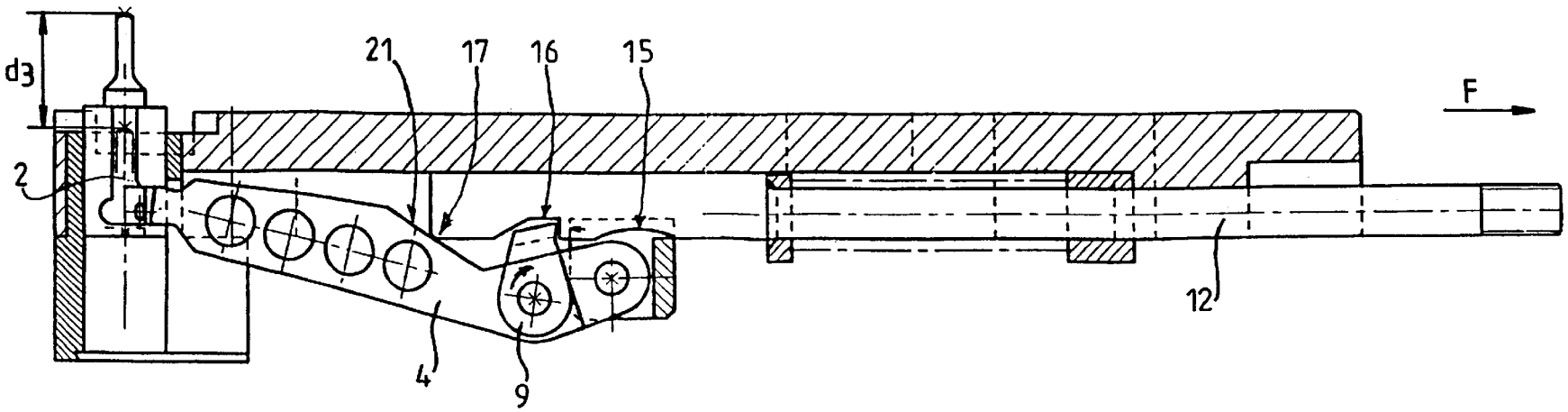
FIG. 4 shows still another stage of operation, from the viewpoint of FIG. 1.

FIG. 4 shows a final operational stage wherein, following additional translation of rod 1, pawl 9 has entered recess 16. The pawl 9 having abruptly entered recess 16, torsion bar 18 now is able to relax, and by means of arm 11 strongly to propel strike pin 2 toward the primer to initiate the detonator. This figure shows the large protrusion d3 of the strike pin relative to support 1, said protrusion being sufficient to initiate the oppositely situated detonator.

New arming takes place in the following manner.

The strike pin 2 is moved by spring 14 back into its initial position, namely in the rest position shown in FIG. 1. The spring is compressed when rod 12 is pulled by the hydraulic jack. During its relaxation displacement, spring 14 moves rod 12 in the direction opposite that of arrow F, and the rod heel 17 moves over a slope 21 on the lever 4 as shown in FIG. 4. This lever 4 is repelled and the pawl 9 is released from the recess 16 by being pivoted about its shaft 10 while passing through the intermediate position shown in FIG. 3, and it resumes its initial FIG. 1 position by returning into recess 16. At the end of this motion, pawl 9 comes back to rest against the surface 8 of lever 4.

Thereupon a new cycle may begin.

Figure 5:
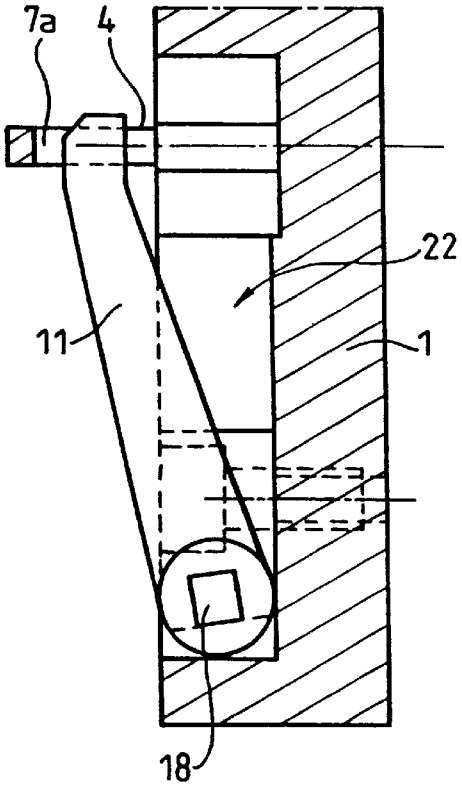
FIG. 5 is a section through plane AA of FIG. 2.

FIG. 5 shows arm 11 driving lever 4. The arm 11 is received in recess 22 in support 1. One end of arm 11 is firmly affixed to torsion bar 18, and its other end enters aperture 7*a* of lever 4.

Figure 7:
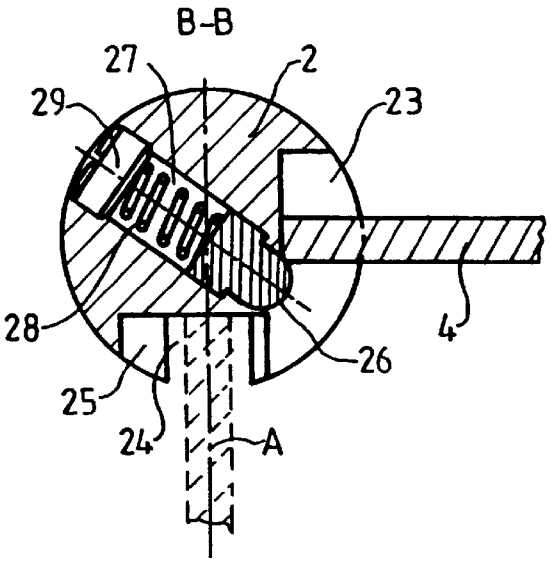
FIG. 7 is a cross-section through plane BB of FIG. 6.
Figure 6:
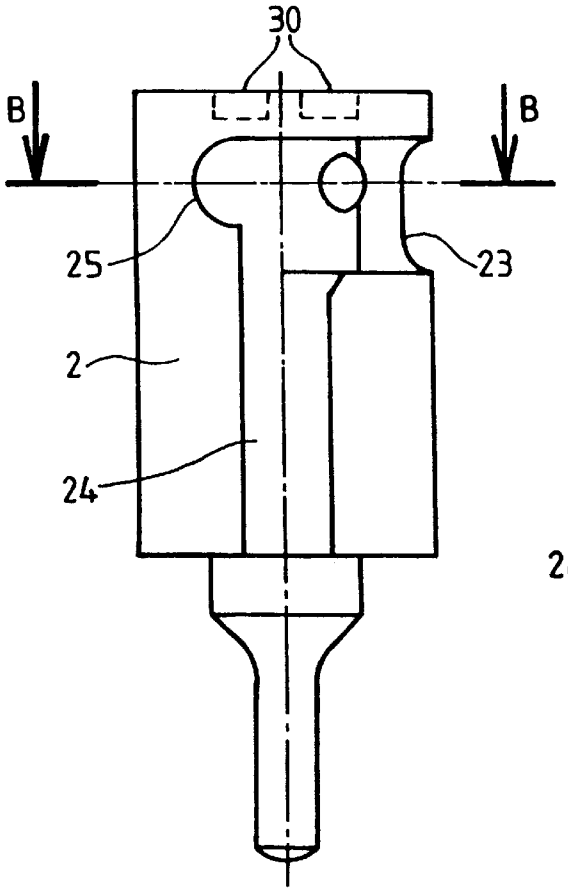
FIG. 6 is an exterior view of the strike pin.

FIG. 6 is an exterior view of strike pin 2 which comprises a first groove 23 perpendicular to the pin's axis, a second groove 24 parallel to the pin's axis, and a connection means 25 between these two grooves. In operation, lever 4 is situated in the first groove 23, and its excursion is limited by stud 26 entering first groove 23; see FIG. 7. This stud enters seat 27 in the strike pin and is pressed by spring 28 resting on plug 29 screwed into seat 27. Seat 27 and the pin 26 each are fitted with a shoulder making it possible to adjust the final pin position. Moreover, strike pin 2 may be removed from its housing to exchange or disarm it. For that purpose the strike pin 2 is fitted on its rear surface with two recesses 30 (see FIG. 6) for accepting a tool to rotate the strike pin by as much as a quarter turn. Rotating the strike pin 2 pushes pin 26 back against the force of spring 28, and in this manner lever 4 then can move from first groove 23 into second groove 24. Subsequently the strike pin may be removed from its housing. The reverse procedure is followed to replace said strike pin.

What is claimed is:

1. An ordnance firing mechanism for striking a detonator, comprising a strike pin (2) mounted for translation relative to a support (1), the strike pin (2) being translatable by actuation means (4, 9, 11, 12, 18) for sequentially:

moving the strike pin from a rest position to an armed position wherein a strike-pin propelling device is armed;

moving the strike pin from an armed position into a firing position wherein it is forced by the propelling device against a detonator and returning the strike pin to its rest position and retaining it there;

the actuation means comprising:

a lever (4) connected to the strike pin (2) and pivotable relative to the support (1);

a pivotable pawl (9) for releasing the lever (4), a propelling device (11, 18) affixed to support (1) for driving the lever; and drive means (12) for acting on the pawl (9) and through the pawl for rotating the lever (4), arming the strike pin (2), and then releasing the lever (4);

said propelling device comprising a movable rod (12) translatable relative to said support (1), said movable rod having recesses (15, 16) therein that cooperate with the pawl (9) and having a heel (17) that cooperates with the lever (4), wherein said recesses comprise a first recess (15) having a cylindrical contour for rotating the pawl (9) and a second recess (16) adjacent said first recess, the second recess having a depth corresponding to a strike depth of the strike pin and for receiving the pawl (9) for rotating the lever (4) about its shaft (6).

2. The firing mechanism of claim 1, wherein heel (17) is situated beyond the second recess (16) for cooperating with a slope (21) on the lever (4) for returning the lever to an initial position.

3. The firing mechanism of claim 1 additionally comprising a return spring for returning said movable rod (12) to its initial position.

4. The firing mechanism of claim 1, wherein the propelling device comprises an arm (11) one end of which rests against the lever (4) and the other end of which is joined to a torsion bar (18), the other end of the arm and the other end of the bar being affixed to the support (1).

5. The firing mechanism of claim 1 wherein one end of the lever (4) is affixed to the strike pin (2), the other end is affixed to a shaft (6) for rotation about the support (1), the pawl (9) being mounted for rotation relative to the lever (4) at a location between the two ends of the lever.

6. The firing mechanism of claim 4, wherein the torsion bar (18) is prestressed.

7. The firing mechanism of claim 1, wherein the lever (4) is in the form of a plate with apertures (7) for reducing its weight.

8. The firing mechanism of claim 1, wherein the pawl (9) is attached to the lever (4) by a spring.

9. The firing mechanism of claim 1, wherein the strike pin (2) includes a first groove (23) perpendicular to the strike-pin's axis and which receives an end of the lever (4), and a pin (26) enters said lever end to keep the lever in said groove.

10. The firing mechanism of claim 9, wherein the strike pin (2) comprises means for removing it comprising at least two recesses (3) on is rear surface for gripping, and a second groove (24) parallel to the strike-pin axis and communicating with the first groove (23), the lever (4) being movable through the second groove (24) after the pin (26) has been retracted and the strike pin has been rotated.

* * * * *